US008070913B2

(12) United States Patent
Salaam et al.

(10) Patent No.: US 8,070,913 B2
(45) **Date of Patent: *Dec. 6, 2011**

(54) SOFT TISSUE PAPER HAVING A POLYHYDROXY COMPOUND APPLIED ONTO A SURFACE THEREOF

(75) Inventors: LaTisha Evette Salaam, Cincinnati, OH (US); Michael Scott Prodoehl, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/956,380

(22) Filed: Nov. 30, 2010

(65) Prior Publication Data

US 2011/0104443 A1 May 5, 2011

Related U.S. Application Data

(63) Continuation of application No. 12/011,557, filed on Jan. 28, 2008, now Pat. No. 7,867,361.

(51) Int. Cl.
*D21H 27/30* (2006.01)
*D21H 19/72* (2006.01)

(52) U.S. Cl. ..... 162/123; 162/127; 162/135; 162/168.1; 162/179; 162/158; 428/172; 428/195.1; 424/402

(58) Field of Classification Search ..... 162/109, 162/123, 125, 127, 135–136, 158, 179, 164.1, 162/168.1; 428/195.1, 172; 424/402
See application file for complete search history.

(56) References Cited

U.S. PATENT DOCUMENTS

| | | | | | |
|---|---|---|---|---|---|
| 2,388,326 | A | * | 11/1945 | Hyden et al. | 428/327 |
| 2,826,551 | A | | 3/1958 | Geen et al. | |
| 3,700,623 | A | | 10/1972 | Keim | |
| 3,772,076 | A | | 11/1973 | Keim | |
| 3,964,500 | A | | 6/1976 | Drakoff | |
| 3,994,771 | A | | 11/1976 | Morgan, Jr. et al. | |
| 4,011,389 | A | | 3/1977 | Langdon | |
| 4,166,001 | A | | 8/1979 | Dunning et al. | |
| 4,300,981 | A | | 11/1981 | Carstens | |
| 4,364,837 | A | | 12/1982 | Pader | |
| 4,486,374 | A | | 12/1984 | Stelzer | |
| 4,529,480 | A | | 7/1985 | Trokhan | |
| 4,764,418 | A | * | 8/1988 | Kuenn et al. | 442/118 |
| 4,874,465 | A | | 10/1989 | Cochrane et al. | |
| 4,981,557 | A | | 1/1991 | Bjorkquist | |
| 5,059,282 | A | | 10/1991 | Ampulski et al. | |
| 5,215,626 | A | | 6/1993 | Ampulski et al. | |
| 5,223,096 | A | | 6/1993 | Phan | |
| 5,228,954 | A | | 7/1993 | Vinson et al. | |
| 5,240,562 | A | | 8/1993 | Phan | |
| 5,246,545 | A | | 9/1993 | Ampulski et al. | |
| 5,334,286 | A | * | 8/1994 | Van Phan et al. | 162/158 |
| 5,385,642 | A | * | 1/1995 | Van Phan et al. | 162/112 |
| 5,397,435 | A | * | 3/1995 | Ostendorf et al. | 162/112 |
| 5,405,499 | A | | 4/1995 | Vinson | |
| 5,405,501 | A | * | 4/1995 | Phan et al. | 162/127 |
| 5,415,737 | A | | 5/1995 | Phan et al. | |
| 5,427,696 | A | * | 6/1995 | Phan et al. | 162/158 |
| 5,437,766 | A | * | 8/1995 | Van Phan et al. | 162/127 |
| 5,474,689 | A | * | 12/1995 | Laughlin et al. | 162/158 |
| 5,510,000 | A | | 4/1996 | Phan et al. | |
| 5,525,345 | A | | 6/1996 | Warner et al. | |
| 5,529,665 | A | | 6/1996 | Kaun | |
| 5,538,595 | A | | 7/1996 | Trokhan et al. | |
| 5,543,067 | A | * | 8/1996 | Phan et al. | 106/287.25 |
| 5,558,873 | A | | 9/1996 | Funk | |
| 5,575,891 | A | | 11/1996 | Trokhan | |
| 5,624,532 | A | | 4/1997 | Trokhan et al. | |
| 5,814,188 | A | * | 9/1998 | Vinson et al. | 162/109 |
| 5,840,403 | A | * | 11/1998 | Trokhan et al. | 428/154 |
| 5,851,352 | A | * | 12/1998 | Vinson et al. | 162/112 |
| 5,981,044 | A | * | 11/1999 | Phan et al. | 428/212 |
| 6,117,525 | A | * | 9/2000 | Trokhan et al. | 428/154 |
| 6,162,327 | A | * | 12/2000 | Batra et al. | 162/109 |
| 6,238,682 | B1 | * | 5/2001 | Klofta et al. | 424/402 |
| 6,261,580 | B1 | * | 7/2001 | Lehrter et al. | 424/402 |
| 6,268,028 | B1 | * | 7/2001 | Buchanan et al. | 428/34.2 |
| 6,416,626 | B1 | * | 7/2002 | Park et al. | 162/168.1 |
| 6,855,229 | B2 | * | 2/2005 | McKay et al. | 162/158 |
| 7,147,751 | B2 | | 12/2006 | Shannon | |
| 7,195,771 | B1 | | 3/2007 | Hsu | |
| 7,867,361 | B2 | * | 1/2011 | Salaam et al. | 162/123 |
| 7,972,475 | B2 | * | 7/2011 | Chan et al. | 162/111 |
| 2004/0144511 | A1 | * | 7/2004 | McKay et al. | 162/158 |
| 2004/0188045 | A1 | * | 9/2004 | McKay et al. | 162/158 |
| 2005/0136265 | A1 | | 6/2005 | Liu | |
| 2006/0278357 | A1 | * | 12/2006 | Suzuki et al. | 162/117 |
| 2008/0087395 | A1 | * | 4/2008 | Prodoehl et al. | 162/125 |
| 2009/0104430 | A1 | * | 4/2009 | Cordial et al. | 428/322.7 |
| 2009/0188636 | A1 | * | 7/2009 | Salaam et al. | 162/112 |
| 2009/0188637 | A1 | * | 7/2009 | Chan et al. | 162/112 |
| 2011/0104443 | A1 | * | 5/2011 | Salaam et al. | 428/154 |

FOREIGN PATENT DOCUMENTS

| | | | |
|---|---|---|---|
| EP | 0 613 979 | A1 | 9/1994 |
| EP | 0 688 901 | A2 | 12/1995 |
| EP | 0 803012 | B1 | 6/1999 |
| GB | 849433 | | 9/1960 |
| WO | WO 2005/103356 | A2 | 11/2005 |
| WO | WO 2006/038936 | A1 | 4/2006 |
| WO | WO 2007025095 | A1 * | 3/2007 |

OTHER PUBLICATIONS

Lammle, S., "Use of Glycerine as a Softener for Paper Product", *The World's Paper Trade Review*, pp. 2051-2056, Dec. 13, 1962.

* cited by examiner

*Primary Examiner* — José A Fortuna
(74) *Attorney, Agent, or Firm* — Peter D. Meyer

(57) ABSTRACT

A tissue paper product having at least one ply, wherein only one outer surface of said tissue paper product has a polyhydroxy compound selected from the group consisting of glycerols, polyglycerols, polyethylene glycols (PEGS), polyoxyethylenes, polyoxypropylenes, and combinations thereof applied thereto by slot extrusion, said polyhydroxy compound providing said tissue paper product with a Wet Burst greater than about 90 g, a Dynamic Coefficient of Friction less than about 0.9, and a Bending Flexibility less than about 0.1 gf $cm^2$/cm.

21 Claims, No Drawings

SOFT TISSUE PAPER HAVING A POLYHYDROXY COMPOUND APPLIED ONTO A SURFACE THEREOF

PRIORITY DATA

This application is a continuation of U.S. application Ser. No. 12/011,557 filed on Jan. 28, 2008, now U.S. Pat. No. 7,867,361.

FIELD OF THE INVENTION

This invention relates, in general, to tissue paper products. More specifically, it relates to tissue paper products having polyhydroxy compounds applied thereto.

BACKGROUND OF THE INVENTION

Sanitary paper tissue products are widely used. Such items are commercially offered in formats tailored for a variety of uses such as facial tissues, toilet tissues and absorbent towels.

All of these sanitary products share a common need, specifically to be soft to the touch. Softness is a complex tactile impression elicited by a product when it is stroked against the skin. The purpose of being soft is so that these products can be used to cleanse the skin without being irritating. Effectively cleansing the skin is a persistent personal hygiene problem for many people. Objectionable discharges of urine, menses, and fecal matter from the perineal area or otorhinolaryngogical mucus discharges do not always occur at a time convenient for one to perform a thorough cleansing, as with soap and copious amounts of water for example. As a substitute for thorough cleansing, a wide variety of tissue and toweling products are offered to aid in the task of removing from the skin and retaining the before mentioned discharges for disposal in a sanitary fashion. Not surprisingly, the use of these products does not approach the level of cleanliness that can be achieved by the more thorough cleansing methods, and producers of tissue and toweling products are constantly striving to make their products compete more favorably with thorough cleansing methods.

Accordingly, making soft tissue and toweling products which promote comfortable cleaning without performance impairing sacrifices has long been the goal of the engineers and scientists who are devoted to research into improving tissue paper. There have been numerous attempts to reduce the abrasive effect, i.e., improve the softness of tissue products.

One area that has been exploited in this regard has been to select and modify cellulose fiber morphologies and engineer paper structures to take optimum advantages of the various available morphologies. Applicable art in this area include in U.S. Pat. Nos. 5,228,954; 5,405,499; 4,874,465; and 4,300,981.

Another area which has received a considerable amount of attention is the addition of chemical softening agents (also referred to herein as "chemical softeners") to tissue and toweling products.

As used herein, the term "chemical softening agent" refers to any chemical ingredient which improves the tactile sensation perceived by the consumer who holds a particular paper product and rubs it across the skin. Although somewhat desirable for towel products, softness is a particularly important property for facial and toilet tissues. Such tactile perceivable softness can be characterized by, but is not limited to, friction, flexibility, and smoothness, as well as subjective descriptors, such as lubricious, velvet, silk or flannel, which imparts a lubricious feel to tissue. This includes, for exemplary purposes only, polyhydroxy compounds.

Thus, it would be advantageous to provide for the addition of chemical softeners to already-dried paper webs either at the so-called dry end of the papermaking machine or in a separate converting operation subsequent to the papermaking step. Exemplary art from this field includes U.S. Pat. Nos. 5,215,626; 5,246,545; and 5,525,345. While each of these references represents advances over the previous so-called wet end methods particularly with regard to eliminating the degrading effects on the papermaking process, none are able to completely address the necessary degree of softness required by consumers.

One of the most important physical properties related to softness is generally considered by those skilled in the art to be the strength of the web. Strength is the ability of the product, and its constituent webs, to maintain physical integrity and to resist tearing, bursting, and shredding under use conditions. Achieving a high softening potential without degrading strength has long been an object of workers in the field of the present invention.

Accordingly, it would be desirable to be able to soften tissue paper, in particular high bulk, pattern densified tissue papers, by a process that: (1) can be carried out in a commercial papermaking system without significantly impacting on machine operability; (2) uses softeners that are nontoxic and biodegradable; and (3) can be carried out in a manner so as to maintain desirable tensile strength, absorbency and low lint properties of the tissue paper.

SUMMARY OF THE INVENTION

One embodiment of the present invention provides for a tissue paper product having at least two plies. Only one outer surface of said tissue paper product has a polyhydroxy compound selected from the group consisting of glycerols, polyglycerols, polyethylene glycols (PEGs), polyoxyethylenes, polyoxypropylenes, and combinations thereof applied thereto by slot extrusion. The polyhydroxy compound provides the tissue paper product with a Wet Burst greater than about 90 g, a Dynamic Coefficient of Friction less than about 0.9, and a Bending Flexibility less than about 0.042 gf $cm^2$/cm.

Another embodiment of the present invention provides for a tissue paper product having at least one ply. Only one outer surface of the tissue paper product has a polyhydroxy compound selected from the group consisting of glycerols, polyglycerols, polyethylene glycols (PEGs), polyoxyethylenes, polyoxypropylenes, and combinations thereof applied thereto by slot extrusion. The polyhydroxy compound provides the tissue paper product with a Wet Burst/Total Dry Tensile ratio of greater than about 0.12, a Dynamic Coefficient of Friction of less than about 0.85, and a Bending Flexibility of less than about 0.042 gf $cm^2$/cm.

DETAILED DESCRIPTION OF THE INVENTION

As used herein, the term "water soluble" refers to materials that are soluble in water to at least 3%, by weight, at 25° C.

As used herein, the terms "tissue paper web, paper web, web, paper sheet and paper product" are all used interchangeably to refer to sheets of paper made by a process comprising the steps of forming an aqueous papermaking furnish, depositing this furnish on a foraminous surface, such as a Fourdrinier wire, and removing the water from the furnish (e.g., by gravity or vacuum-assisted drainage), forming an embryonic web, transferring the embryonic web from the forming surface to a transfer surface traveling at a lower speed than the forming surface. The web is then transferred to a fabric upon which it is through air dried to a final dryness after which it is wound upon a reel.

The terms "multi-layered tissue paper web, multi-layered paper web, multi-layered web, multi-layered paper sheet and multi-layered paper product" are all used interchangeably in the art to refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries upon one or more endless foraminous surfaces. If the individual layers are initially formed on separate foraminous surfaces, the layers can be subsequently combined when wet to form a multi-layered tissue paper web.

As used herein, the term "single-ply tissue product" means that it is comprised of one ply of uncreped tissue; the ply can be substantially homogeneous in nature or it can be a multi-layered tissue paper web. As used herein, the term "multi-ply tissue product" means that it is comprised of more than one ply of uncreped tissue. The plies of a multi-ply tissue product can be substantially homogeneous in nature or they can be multi-layered tissue paper webs.

As used herein, the term "polyhydroxy compounds" is defined as a chemical agent that imparts lubricity or emolliency to tissue paper products and also possesses permanence with regard to maintaining the fidelity of its deposits without substantial migration when exposed to the environmental conditions to which products of this type are ordinarily exposed during their typical life cycle. The present invention contains as an essential component from about 2.0% to about 30.0%, preferably from 5% to about 20.0%, more preferably from about 8.0% to about 15.0%, of a water soluble polyhydroxy compound, based on the dry fiber weight of the tissue paper.

Examples of water soluble polyhydroxy compounds suitable for use in the present invention include glycerol and polyethylene glycols (PEGs), polyglycerols having a weight average molecular weight of from about 150 to about 800 and polyoxyethylene and polyoxypropylene having a weight-average molecular weight of from about 200 to about 4000, preferably from about 200 to about 1000, most preferably from about 200 to about 600. Polyoxyethylene having a weight average molecular weight of from about 200 to about 600 are especially preferred. Mixtures of the above-described polyhydroxy compounds may also be used. For example, mixtures of glycerol and polyglycerols, mixtures of glycerol and polyoxyethylenes, 'mixtures of polyglycerols and polyoxyethylenes, etc. are useful in the present invention. A particularly preferred polyhydroxy compound is polyoxyethylene having a weight average molecular weight of about 200. This material is available commercially from the BASF Corporation of Florham Park, N.J. under the trade names "Pluriol E200" and "Pluracol E200".

The soft tissue paper of the present invention preferably has a basis weight ranging from between about 5 g/m$^2$ and about 120 g/m$^2$, more preferably between about 10 g/m$^2$ and about 75 g/m$^2$, and even more preferably between about 10 g/m$^2$ and about 50 g/m$^2$. The soft tissue paper of the present invention preferably has a density ranging from between about 0.01 g/cm$^3$ and about 0.19 g/cm$^3$, more preferably between about 0.02 g/m$^3$ and about 0.1 g/cm$^3$, and even more preferably between about 0.03 g/cm$^3$ and about 0.08 g/cm$^3$.

The soft tissue paper of the present invention further comprises papermaking fibers of both hardwood and softwood types wherein at least about 50% of the papermaking fibers are hardwood and at least about 10% are softwood. The hardwood and softwood fibers are most preferably isolated by relegating each to separate layers wherein the tissue comprises an inner layer and at least one outer layer.

The tissue paper product of the present invention is preferably creped, i.e., produced on a papermaking machine culminating with a Yankee dryer to which a partially dried papermaking web is adhered and upon which it is dried and from which it is removed by the action of a flexible creping blade.

Creping is a means of mechanically compacting paper in the machine direction. The result is an increase in basis weight (mass per unit area) as well as dramatic changes in many physical properties, particularly when measured in the machine direction. Creping is generally accomplished with a flexible blade, a so-called doctor blade, against a Yankee dryer in an on machine operation.

A Yankee dryer is a large diameter, generally 8-20 foot drum which is designed to be pressurized with steam to provide a hot surface for completing the drying of papermaking webs at the end of the papermaking process. The paper web which is first formed on a foraminous forming carrier, such as a Fourdrinier wire, where it is freed of the copious water needed to disperse the fibrous slurry is generally transferred to a felt or fabric in a so-called press section where de-watering is continued either by mechanically compacting the paper or by some other de-watering method such as through-drying with hot air, before finally being transferred in the semi-dry condition to the surface of the Yankee for the drying to be completed.

While the characteristics of the creped paper webs, particularly when the creping process is preceded by methods of pattern densification, are preferred for practicing the present invention, un-creped tissue paper is also a satisfactory substitute and the practice of the present invention using un-creped tissue paper is specifically incorporated within the scope of the present invention. Un-creped tissue paper, a term as used herein, refers to tissue paper which is non-compressively dried, most preferably by through-drying. Resultant through air dried webs are pattern densified such that zones of relatively high density are dispersed within a high bulk field, including pattern densified tissue wherein zones of relatively high density are continuous and the high bulk field is discrete.

To produce un-creped tissue paper webs, an embryonic web is transferred from the foraminous forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

Tissue paper webs are generally comprised essentially of papermaking fibers. Small amounts of chemical functional agents such as wet strength or dry strength binders, retention aids, surfactants, size, chemical softeners, crepe facilitating compositions are frequently included but these are typically only used in minor amounts. The papermaking fibers most frequently used in tissue papers are virgin chemical wood pulps. Additionally, filler materials may also be incorporated into the tissue papers of the present invention.

Preferably, softening agents such as quaternary ammonium compounds can be added to the papermaking slurry. Preferred exemplary quaternary compounds have the formula:

$$(R_1)_{4-m}—N^+—[R_2]_mX^-$$

wherein:

m is 1 to 3;

$R_1$ is a $C_1$-$C_6$ alkyl group, hydroxyalkyl group, hydrocarbyl or substituted hydrocarbyl group, alkoxylated group, benzyl group, or mixtures thereof;

$R_2$ is a $C_{14}$-$C_{22}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention.

Preferably, each $R_1$ is methyl and $X^-$ is chloride or methyl sulfate. Preferably, each $R_2$ is $C_{16}$-$C_{18}$ alkyl or alkenyl, most preferably each $R_2$ is straight-chain $C_{18}$ alkyl or alkenyl. Optionally, the $R_2$ substituent can be derived from vegetable oil sources.

Such structures include the well-known dialkyldimethylammonium salts (e.g. ditallowedimethylammonium chloride, ditallowedimethylammonium methyl sulfate, di(hydrogenated tallow)dimethyl ammonium chloride, etc.), in which $R_1$ are methyl groups, $R_2$ are tallow groups of varying levels of saturation, and $X^-$ is chloride or methyl sulfate.

As discussed in Swern, Ed. in Bailey's Industrial Oil and Fat Products, Third Edition, John Wiley and Sons (New York 1964) tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements the saturation level of the ditallow can be tailored from non-hydrogenated (soft) to touch, partially or completely hydrogenated (hard). All of above-described levels of saturations are expressly meant to be included within the scope of the present invention.

Particularly preferred variants of these softening agents are what are considered to be mono- or di-ester variations of these quaternary ammonium compounds having the formula:

$$(R_1)_{4-m}—N^+—[(CH_2)_n—Y—R_3]_mX^-$$

wherein:

Y is —O—(O)C—, or —C(O)—O—, or —NH—C(O)—, or —C(O)—NH—;

m is 1 to 3;

n is 0 to 4;

each $R_1$ is a $C_1$-$C_6$ alkyl group, hydroxyalkyl group, hydrocarbyl or substituted hydrocarbyl group, alkoxylated group, benzyl group, or mixtures thereof;

each $R_3$ is a $C_{13}$-$C_{21}$ alkyl group, hydroxyalkyl group, hydrocarbyl or substituted hydrocarbyl group, alkoxylated group, benzyl group, or mixtures thereof; and $X^-$ is any softener-compatible anion.

Preferably, Y=—O—(O)C—, or —C(O)—O—; m=2; and n=2. Each $R_1$ substituent is preferably a $C_1$-$C_3$, alkyl group, with methyl being most preferred. Preferably, each $R_3$ is $C_{13}$-$C_{17}$ alkyl and/or alkenyl, more preferably $R_3$ is straight chain $C_{15}$-$C_{17}$ alkyl and/or alkenyl, $C_{15}$-$C_{17}$ alkyl, most preferably each $R_3$ is straight-chain $C_{1-7}$ alkyl. Optionally, the $R_3$ substituent can be derived from vegetable oil sources.

As mentioned above, $X^-$ can be any softener-compatible anion, for example, acetate, chloride, bromide, methylsulfate, formate, sulfate, nitrate and the like. Preferably $X^-$ is chloride or methyl sulfate.

Specific examples of ester-functional quaternary ammonium compounds having the structures detailed above and suitable for use in the present invention may include the diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated)tallow dimethyl ammonium methyl sulfate, diester di(hydrogenated)tallow dimethyl ammonium chloride, and mixtures thereof. Diester ditallow dimethyl ammonium chloride and diester di(hydrogenated)tallow dimethyl ammonium chloride are particularly preferred. These particular materials are available commercially from Witco Chemical Company Inc. of Dublin, Ohio under the tradename "ADOGEN SDMC".

Typically, half of the fatty acids present in tallow are unsaturated, primarily in the form of oleic acid. Synthetic as well as natural "tallows" fall within the scope of the present invention. It is also known that depending upon the product characteristic requirements desired in the final product, the saturation level of the ditallow can be tailored from non hydrogenated (soft) to touch, partially or completely hydrogenated (hard). All of above-described levels of saturations are expressly meant to be included within the scope of the present invention.

It will be understood that substituents $R_1$, $R_2$ and $R_3$ may optionally be substituted with various groups such as alkoxyl, hydroxyl, or can be branched. As mentioned above, preferably each $R_1$ is methyl or hydroxyethyl. Preferably, each $R_2$ is $C_{12}$-$C_{18}$ alkyl and/or alkenyl, most preferably each $R_2$ is straight-chain $C_{16}$-$C_{18}$ alkyl and/or alkenyl, most preferably each $R_2$ is straight-chain $C_{18}$ alkyl or alkenyl. Preferably $R_3$ is C13-C17 alkyl and/or alkenyl, most preferably $R_3$ is straight chain $C_{15}$-$C_{17}$ alkyl and/or alkenyl. Preferably, $X^-$ is chloride or methyl sulfate. Furthermore the ester-functional quaternary ammonium compounds can optionally contain up to about 10% of the mono(long chain alkyl) derivatives, e.g., $(R_2)_2$—$N^+$—$((CH_2)_2OH)$ $((CH_2)_2OC(O)R_3)$ $X^-$ as minor ingredients. These minor ingredients can act as emulsifiers and can be useful in the present invention.

Other types of suitable quaternary ammonium compounds for use in the present invention are described in U.S. Pat. Nos. 5,543,067; 5,538,595; 5,510,000; 5,415,737, and European Patent Application No. 0 688 901 A2.

Di-quaternary variations of the ester-functional quaternary ammonium compounds can also be used, and are meant to fall within the scope of the present invention. These compounds have the formula:

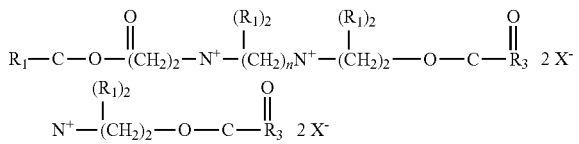

In the structure named above each $R_1$ is a $C_1$-$C_6$ alkyl or hydroxyalkyl group, $R_3$ is $C_{11}$-$C_{21}$ hydrocarbyl group, n is 2 to 4 and $X^-$ is a suitable anion, such as a halide (e.g., chloride or bromide) or methyl sulfate. Preferably, each $R_3$ is $C_{13}$-$C_{17}$ alkyl and/or alkenyl, most preferably each $R_3$ is straight-chain $C_{15}$-$C_{17}$ alkyl and/or alkenyl, and $R_1$ is a methyl.

While not wishing to be bound by theory, it is believed that the ester moiety(ies) of the quaternary compounds provides a measure of biodegradability. It is believed the ester-functional quaternary ammonium compounds used herein biodegrade more rapidly than do conventional dialkyl dimethyl ammonium chemical softeners.

The use of quaternary ammonium ingredients before is most effectively accomplished if the quaternary ammonium ingredient is accompanied by an appropriate plasticizer. The plasticizer can be added during the quaternizing step in the manufacture of the quaternary ammonium ingredient or it can be added subsequent to the quaternization but prior to the application in the papermaking slurry as a chemical softening agent. The plasticizer is characterized by being substantially inert during the chemical synthesis, but acts as a viscosity reducer to aid in the synthesis and subsequent handling, i.e. application of the quaternary ammonium compound to the tissue paper product. Preferred pasticizers are comprised of a combination of a non-volatile polyhydroxy compound and a fatty acid. Preferred polyhydroxy compounds include glycerol and polyethylene glycols having a molecular weight of from about 200 to about 2000, with polyethylene glycol having a molecular weight of from about 200 to about 600 being particularly preferred. Preferred fatty acids comprise $C_6$-$C_{23}$ linear or branched and saturated or unsaturated analogs with isostearic acid being the most preferred.

While not wishing to be bound by theory, it is believed that a synergism results from the relationship of the polyhydroxy compound and the fatty acid in the mixture. While the polyhydroxy compound performs the essential function of viscosity reduction, it can be quite mobile after being laid down thus detracting from one of the objects of the present invention, i.e. that the deposited softener be. The inventors have now found that the addition of a small amount of the fatty acid is able to stem the mobility of the polyhydroxy compound and further reduce the viscosity of the mixture so as to increase the processability of compositions of a given quaternary ammonium compound fraction.

Alternative embodiments of preferred chemical softening agents suitable for addition to the papermaking slurry comprise well-known organo-reactive polydimethyl siloxane ingredients, including the most preferred—amino functional polydimethyl siloxane. In this regard, a most preferred form of the chemical softening agent is to combine the organo-reactive silicone with a suitable quaternary ammonium compound. In this embodiment the organo-reactive silicone is preferred to be an amino polydimethyl siloxane and is used at an amount ranging from 0 up to about 50% of the composition by weight, with a preferred usage being in the range of about 5% to about 15% by weight based on the weight of the polysiloxane relative to the total softening agent. Fatty acids useful in this embodiment of the present invention comprises $C_6$-$C_{23}$ linear, branched, saturated, or unsaturated analogs. The most preferred form of such a fatty acid is isostearic acid. One particularly preferred chemical softening agent contains from about 0.1% to about 70% of a polysiloxane compound.

Polysiloxanes which are applicable to chemical softening compositions include polymeric, oligomeric, copolymeric, and other multiple monomeric siloxane materials. As used herein, the term polysiloxane shall include all of such polymeric, oligomeric, copolymeric, and other multiple-monomeric materials. Additionally, the polysiloxane can be straight chained, branched chain, or have a cyclic structure.

Preferred polysiloxane materials include those having monomeric siloxane units of the following structure:

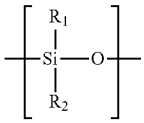

wherein, $R_1$ and $R_1$ for each siloxane monomeric unit can independently be any alkyl, aryl, alkenyl, alkaryl, aralkyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the radicals can be either a straight chain, a branched chain, or have a cyclic structure. The radicals $R_1$ and $R_2$ can, additionally and independently be other silicone functionalities such as, but not limited to siloxanes, polysiloxanes, and polysilanes. The radicals $R_1$ and $R_2$ can also contain any of a variety of organic functionalities including, for example, alcohol, carboxylic acid, and amine functionalities. Reactive, organo-functional silicones, especially amino-functional silicones are preferred for the present invention.

Preferred polysiloxanes include straight chain organopolysiloxane materials of the following general formula:

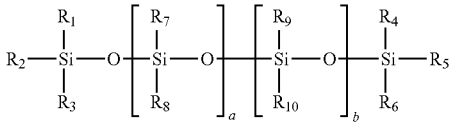

wherein each $R_1$-$R_9$ radical can independently be any $C_1$-$C_{10}$ unsubstituted alkyl or aryl radical, and $R_{10}$ of any substituted $C_1$-$C_{10}$ alkyl or aryl radical. Preferably each $R_1$-$R_9$ radical is independently any $C_1$-$C_4$ unsubstituted alkyl group those skilled in the art will recognize that technically there is no difference whether, for example, $R_9$ or $R_{10}$ is the substituted radical. Preferably the mole ratio of b to (a+b) is between 0 and about 20%, more preferably between 0 and about 10%, and most preferably between about 1% and about 5%.

In one particularly preferred embodiment, $R_1$-$R_9$ are methyl groups and $R_{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxane include, for example, polydimethylsiloxane having an alkyl hydrocarbon $R_{10}$ radical and polydimethylsiloxane having one or more amino, carboxyl, hydroxyl, ether, polyether, aldehyde, ketone, amide, ester, thiol, and/or other functionalities including alkyl and alkenyl analogs of such functionalities. For example, an amino functional alkyl group as $R_{10}$ could be an amino functional or an aminoalkyl-functional polydimethylsiloxane. The exemplary listing of these polydimethylsiloxanes is not meant to thereby exclude others not specifically listed.

Viscosity of polysiloxanes useful for this invention may vary as widely as the viscosity of polysiloxanes in general vary, so long as the polysiloxane can be rendered into a form which can be applied to the tissue paper product herein. This includes, but is not limited to, viscosity as low as about 25 centistokes to about 20,000,000 centistokes or even higher. High viscosity polysiloxanes which themselves are resistant to flowing can be effectively deposited by emulsifying with a surfactant or dissolution into a vehicle, such as hexane, listed for exemplary purposes only.

While not wishing to be bound by theory, it is believed that the tactile benefit efficacy is related to average molecular weight and that viscosity is also related to average molecular weight. Accordingly, due to the difficulty of measuring molecular weight directly, viscosity is used herein as the apparent operative parameter with respect to imparting softness to tissue paper.

References disclosing polysiloxanes include U.S. Pat. Nos. 2,826,551; 3,964,500; 4,364,837; 5,059,282; 5,529,665; 5,552,020; and British Patent 849,433.

It is anticipated that wood pulp in all its varieties will normally comprise the tissue papers with utility in this invention. However, other cellulose fibrous pulps, such as cotton linters, bagasse, rayon, etc., can be used and none are disclaimed. Wood pulps useful herein include chemical pulps such as, sulfite and sulfate (sometimes called Kraft) pulps as well as mechanical pulps including for example, ground wood, ThermoMechanical Pulp (TMP) and Chemi-Thermo-Mechanical Pulp (CTMP). Pulps derived from both deciduous and coniferous trees can be used.

Hardwood pulps and softwood pulps, as well as combinations of the two, may be employed as papermaking fibers for the tissue paper of the present invention. The term "hardwood pulps" as used herein refers to fibrous pulp derived from the woody substance of deciduous trees (angiosperms), whereas "softwood pulps" are fibrous pulps derived from the woody substance of coniferous trees (gymnosperms). Blends of hardwood Kraft pulps, especially eucalyptus, and northern softwood Kraft (NSK) pulps are particularly suitable for making the tissue webs of the present invention. A preferred embodiment of the present invention comprises the use of layered tissue webs wherein, most preferably, hardwood pulps such as eucalyptus are used for outer layer(s) and wherein northern softwood Kraft pulps are used for the inner layer(s). Also applicable to the present invention are fibers derived from recycled paper, which may contain any or all of the above categories of fibers.

In one preferred embodiment of the present invention, which utilizes multiple papermaking furnishes, the furnish containing the papermaking fibers which will be contacted by the particulate filler is predominantly of the hardwood type, preferably of content of at least about 80% hardwood.

Optional Chemical Additives

Other materials can be added to the aqueous papermaking furnish or the embryonic web to impart other characteristics to the product or improve the papermaking process so long as they are compatible with the chemistry of the softening agent and do not significantly and adversely affect the softness, strength, or low dusting character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. One example material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. Common materials for this purpose are silica colloid, or bentonite clay. The incorporation of such materials is expressly included within the scope of the present invention.

If permanent wet strength is desired, the group of chemicals: including polyamide-epichlorohydrin, polyacrylamides, styrene-butadiene latices; insolubilized polyvinyl alcohol; urea-formaldehyde; polyethyleneimine; chitosan polymers and mixtures thereof can be added to the papermaking furnish or to the embryonic web. Polyamide-epichlorohydrin resins are cationic wet strength resins which have been found to be of particular utility. Suitable types of such resins are described in U.S. Pat. Nos. 3,700,623 and 3,772,076. One commercial source of useful polyamide-epichlorohydrin resins is Hercules, Inc. of Wilmington, Del., which markets such resin under the mark Kymene 557H®).

Many paper products must have limited strength when wet because of the need to dispose of them through toilets into septic or sewersystems. If wet strength is imparted to these products, it is preferred to be fugitive wet strength characterized by a decay of part or all of its potency upon standing in presence of water. If fugitive wet strength is desired, the binder materials can be chosen from the group consisting of dialdehyde starch or other resins with aldehyde functionality such as Co-Bond 1000® offered by National Starch and Chemical Company, Parez 750® offered by Cytec of Stamford, Conn. and the resin described in U.S. Pat. No. 4,981,557.

If enhanced absorbency is needed, surfactants may be used to treat the tissue paper webs of the present invention. The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40® which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as Pegosperse 200 mL available from Glyco Chemicals, Inc. (Greenwich, Conn.) and IGEPAL RC-520® available from Rhone Poulenc Corporation (Cranbury, N.J.).

The present invention is further applicable to the production of multi-layered tissue paper webs. Multi-layered tissue structures and methods of forming multi-layered tissue structures are described in U.S. Pat. Nos. 3,994,771; 4,300,981; 4,166,001; and European Patent Publication No. 0 613 979 A1. The layers preferably comprise different fiber types, the fibers typically being relatively long softwood and relatively short hardwood fibers as used in multi-layered tissue paper making. Multi-layered tissue paper webs resultant from the present invention comprise at least two superposed layers, an inner layer and at least one outer layer contiguous with the inner layer. Preferably, the multi-layered tissue papers comprise three superposed layers, an inner or center layer, and two outer layers, with the inner layer located between the two outer layers. The two outer layers preferably comprise a primary filamentary constituent of relatively short paper making fibers having an average fiber length between about 0.5 and about 1.5 mm, preferably less than about 1.0 mm. These short paper making fibers typically comprise hardwood fibers, preferably hardwood Kraft fibers, and most preferably derived from eucalyptus. The inner layer preferably comprises a primary filamentary constituent of relatively long paper making fiber having an average fiber length of least about 2.0 mm. These long paper making fibers are typically softwood fibers, preferably, northern softwood Kraft fibers.

Preferably, the majority of the particulate filler of the present invention is contained in at least one of the outer layers of the multi-layered tissue paper web of the present invention. More preferably, the majority of the particulate filler of the present invention is contained in both of the outer layers.

The tissue paper products made from single-layered or multi-layered un-creped tissue paper webs can be single-ply tissue products or multi-ply tissue products.

The multi-layered tissue paper webs of to the present invention can be used in any application where soft, absorbent multi-layered tissue paper webs are required. Particularly advantageous uses of the multi-layered tissue paper web of this invention are in toilet tissue and facial tissue products. Both single-ply and multi-ply tissue paper products can be produced from the webs of the present invention.

Application of a Polyhydroxy Compounds to Paper Webs

In accordance with the present invention, the polyhydroxy compounds may be applied to a paper web by any application method known in the industry such as, for example, spraying, printing, extrusion, brushing, by means of permeable or impermeable rolls and/or pads. In a first embodiment, the claimed polyhydroxy compound may be applied to a paper web with a slot die. Specifically, the polyhydroxy compound may be extruded onto the surface of a paper web via a heated slot die. The slot die may be any suitable slot die or other means for applying a polyhydroxy compound to the paper web. The slot die or other glue application means may be supplied by any suitable apparatus. For example, the slot die may be supplied by a heated hopper or drum and a variable speed gear pump through a heated hose. The polyhydroxy compound is preferably extruded onto the surface of the paper web at a temperature that permits the polyhydroxy compound to bond to the paper web. Depending on the particular embodiment, the polyhydroxy compound can be at least partially transferred to rolls in a metering stack (if used) and then to the paper web.

Additionally, the polyhydroxy compound may be applied to a paper web by an apparatus comprising a fluid transfer component. The fluid transfer component preferably comprises a first surface and a second surface. The fluid transfer component further preferably comprises pores connecting the first surface and the second surface. The pores are disposed upon the fluid transfer component in a non-random pre-selected pattern. A fluid supply is operably connected to the fluid transfer component such that a fluid (such as the polyhydroxy compound) may contact the first surface of the fluid transfer component. The apparatus further comprises a fluid motivating component. The fluid motivating component provides an impetus for the fluid to move from the first surface to the second surface via the pores. The apparatus further comprises a fluid receiving component comprising a paper web. The paper web comprises a fluid receiving (or outer) surface. The fluid receiving surface may contact droplets of fluid formed upon the second surface. Fluid may pass through pores from the first surface to the second surface and may transfer to the fluid receiving surface.

The fluid transfer component may comprise a hollow cylindrical shell. The cylindrical shell may be sufficiently structural to function without additional internal bracing. The cylindrical shell may comprise a thin outer shell and structural internal bracing to support the cylindrical shell. The cylindrical shell may comprise a single layer of material or may comprise a laminate. The laminate may comprise layers of a similar material or may comprise layers dissimilar in material and structure. In one embodiment the cylindrical shell comprises a stainless steel shell having a wall thickness of about 0.125 inches (3 mm) In another embodiment the fluid transfer component may comprise a flat plate. In another embodiment the fluid transfer component may comprise a regular or irregular polygonal prism.

The fluid application width of the apparatus may be adjusted by providing a single fluid transfer component of appropriate width. Multiple individual fluid application components may be combined in a series to achieve the desired width. In a non-limiting example, a plurality of stainless steel cylinders each having a shell thickness of about 0.125 inches (3 mm) and a width of about 6 inches (about 15 cm) may be coupled end to end with an appropriate seal—such as an o-ring seal between each pair of cylinders. In this example, the number of shells combined may be increased until the desired application width is achieved.

The fluid transfer component preferably further comprises pores connecting the first surface and the second surface. Connecting the surfaces refers to the pores each providing a pathway for the transport of a fluid from the first surface to the second surface. In one embodiment, the pores may be formed by the use of electron beam drilling as is known in the art. Electron beam drilling comprises a process whereby high energy electrons impinge upon a surface resulting in the formation of holes through the material. In another embodiment, the pores may be formed using a laser. In another embodiment, the pores may be formed by using a drill bit. In yet another embodiment, the pores may be formed using electrical discharge machining as if known in the art.

In one embodiment, an array of pores may be disposed to provide a uniform distribution of fluid droplets to maximize the ratio of fluid surface area to applied fluid volume. In one embodiment, this may be used to apply a chemical softening agent in a pattern of dots to maximize the potential for adhesion between two surfaces for any volume of applied chemical softening agent.

The pattern of pores upon the second surface may comprise an array of pores having a substantially similar diameter or may comprise a pattern of pores having distinctly different pore diameters. In an alternative embodiment, the array of pores may comprise a first set of pores having a first diameter and arranged in a first pattern. The array further comprises a second set of pores having a second diameter and arranged in a second pattern. The first and second patterns may be arranged to interact each with the other.

Alternatively, the polyhydroxy compounds may be sprayed directly onto the surface of a paper web using equipment suitable for such a purpose and as well known to those of skill in the art.

Example 1

A 3% by weight aqueous slurry of NSK (northern softwood Kraft) is made in a conventional re-pulper. The NSK slurry is refined, and a 2% solution of Kymene 557LX is added to the NSK stock pipe at a rate sufficient to deliver 1% Kymene 557LX by weight of the dry fibers. The absorption of the wet strength resin is enhanced by passing the treated slurry though an in-line mixer. KYMENE 557LX is supplied by Hercules Corp of Wilmington, Del. A 1% solution of carboxy methyl cellulose is added after the in-line mixer at a rate of 0.15% by weight of the dry fibers to enhance the dry strength of the fibrous structure. The aqueous slurry of NSK fibers passes through a centrifugal stock pump to aid in distributing the CMC. An aqueous dispersion of DiTallow DiMethyl Ammonium Methyl Sulfate (DTDMAMS) (170° F./76.6° C.) at a concentration of 1% by weight is added to the NSK stock pipe at a rate of about 0.05% by weight DTDMAMS per ton of dry fiber weight.

A 3% by weight aqueous slurry of eucalyptus fibers is made in a conventional re-pulper. A 2% solution of Kymene 557LX is added to the eucalyptus stock pipe at a rate sufficient to deliver 0.25% Kymene 557LX by weight of the dry fibers. The absorption of the wet strength resin is enhanced by passing the treated slurry though an in-line mixer.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as separate layers until discharged onto a traveling Fourdrinier wire. A three-chambered headbox is used. The eucalyptus slurry containing 65% of the dry weight of the tissue ply is directed to the chamber leading to the layer in contact with the wire, while the NSK slurry comprising 35% of the dry weight of the ultimate tissue ply is directed to the chamber leading to the center and inside layer. The NSK and eucalyptus slurries are combined at the discharge of the headbox into a composite slurry.

The composite slurry is discharged onto the traveling Fourdrinier wire and is dewatered assisted by a deflector and vacuum boxes. The Fourdrinier wire is of a 5-shed, satin weave configuration having 105 machine-direction and 107 cross-machine-direction monofilaments per inch. The speed of the Fourdrinier wire is about 800 fpm (feet per minute).

The embryonic wet web is dewatered to a consistency of about 15% just prior to transfer to a patterned drying fabric made in accordance with U.S. Pat. No. 4,529,480. The speed of the patterned drying fabric is the same as the speed of the Fourdrinier wire. The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 9 mil above the supporting fabric. The drying fabric for forming the paper web has about 562 discrete deflection regions per square inch. The area of the continuous network is about 50 percent of the surface area of the drying fabric.

Further dewatering is accomplished by vacuum assisted drainage until the web has a fiber consistency of about 25%. While remaining in contact with the patterned drying fabric, the web is pre-dried by air blow-through pre-dryers to a fiber consistency of about 65% by weight. The web is then adhered to the surface of a yankee dryer, and removed from the surface of the dryer by a doctor blade at a consistency of about 97 percent. The Yankee dryer is operated at a surface speed of about 800 feet per minute. The dry web is passed through a rubber-on-steel calendar nip. The dry web is wound onto a roll at a speed of 680 feet per minute to provide dry foreshortening of about 15 percent. The resulting web has between about 562 and about 650 relatively low density domes per square inch (the number of domes in the web is between zero percent to about 15 percent greater than the number of cells in the drying fabric, due to dry foreshortening of the web).

Two plies are combined with the wire side facing out. During the converting process, a surface softening agent is applied with a slot extrusion die to the outside surface of both plies. The surface softening agent is a formula containing one or more polyhydroxy compounds (Polyethylene glycol, Polypropylene glycol, and/or copolymers of the like marketed by BASF Corporation of Florham Park, N.J.), glycerin (marketed by PG Chemical Company), and silicone (i.e. MR-1003, marketed by Wacker Chemical Corporation of Adrian, Mich.). The solution is applied to the web at a rate of 10% by weight. The plies are then bonded together with mechanical plybonding wheels, slit, and then folded into finished 2-ply facial tissue product. Each ply and the combined plies are tested in accordance with the test methods described supra.

Example 2

The individual plies of Example 2 are made according to the process detailed in Example 1 supra. Two plies were combined with the wire side facing out. During the converting process, a surface softening agent is applied with a slot extrusion die to the outside surface of both plies. The surface softening agent is applied by component in the following sequence: silicone (i.e. MR-1003, marketed by Wacker Chemical Corporation of Adrian, Mich.) followed by one or more polyhydroxy compounds (Polyethylene glycol, Polypropylene glycol, and/or copolymers of the like marketed by BASF Corporation of Florham Park, N.J.) and/or glycerin. The polyhydroxy compound may also be mixed with glycerin (marketed by PG Chemical Company). The solution, the neat polyhydroxy or a mixture, with other polyhydroxy compounds and/or glycerin or neat glycerin, is applied to the web at a rate of 20% by weight. The plies are then bonded together with mechanical ply-bonding wheels, slit, and then folded into finished 2-ply facial tissue product. Each user unit tested in accordance with the test methods described supra.

Analytical and Testing Procedures

The following test methods are representative of the techniques utilized to determine the physical characteristics of the multi-ply tissue product associated therewith.

1. Sample Conditioning and Preparation

Unless otherwise indicated, samples are conditioned according to Tappi Method #T4020M-88. Paper samples are conditioned for at least 2 hours at a relative humidity of 48 to 52% and within a temperature range of 22° to 24° C. Sample preparation and all aspects of testing using the following methods are confined to a constant temperature and humidity room.

2. Basis Weight

Basis weight is measured by preparing one or more samples of a certain area (m2) and weighing the sample(s) of a fibrous structure according to the present invention and/or a paper product comprising such fibrous structure on a top loading balance with a minimum resolution of 0.01 g. The balance is protected from air drafts and other disturbances using a draft shield.

Weights are recorded when the readings on the balance become constant. The average weight (g) is calculated and the average area of the samples(m2). The basis weight (g/m2) is calculated by dividing the average weight (g) by the average area of the samples (m2).

3. Density

The density of multi-layered tissue paper, as that term is used herein, is the average density calculated as the basis weight of that paper divided by the caliper, with the appropriate unit conversions incorporated therein. Caliper of the multi-layered tissue paper, as used herein, is the thickness of the paper when subjected to a compressive load of 95 g/in$^2$ (15.5 g/cm$^2$).

4. Wet Burst

For the purposes of determining, calculating, and reporting 'wet burst', 'total dry tensile', and 'dynamic coefficient of friction' values infra, a unit of 'user units' is hereby utilized for the products subject to the respective test method. As would be known to those of skill in the art, bath tissue and paper toweling are typically provided in a perforated roll format where the perforations are capable of separating the tissue or towel product into individual units. A 'user unit' (uu) is the typical finished product unit that a consumer would utilize in the normal course of use of that product. In this way, a single-, double, or even triple-ply finished product that a consumer would normally use would have a value of one user unit (uu). For example, a common, perforated bath tissue or paper towel having a single-ply construction would have a value of 1 user unit (uu) between adjacent perforations. Similarly, a single-ply bath tissue disposed between three adjacent perforations would have a value of 2 user units (2 uu). Likewise, any two-ply finished product that a consumer would normally use and is disposed between adjacent perforations would have a value of one user unit (1 uu). Similarly, any three-ply finished consumer product would normally use and is disposed between adjacent perforations would have a value of one user unit (1 uu). For purposes of facial tissues that are not normally provided in a roll format, but as a stacked plurality of discreet tissues, a facial tissue having one ply would have a value of 1 user unit (uu). An individual two-ply facial tissue product would have a value of one user unit (1 uu), etc.

Wet burst strength is measured using a Thwing-Albert Intelect II STD Burst Tester. 8 uu of tissue are stacked in four groups of 2 uu. Using scissors, cut the samples so that they are approximately 208 mm in the machine direction and approximately 114 mm in the cross-machine direction, each 2 uu thick.

Take one sample strip, holding the sample by the narrow cross direction edges, dipping the center of the sample into a pan filled with about 25 ml of distilled water. Leave the sample in the water four (4.0+/−0.5) seconds. Remove and drain for three (3.0+/−0.5) seconds holding the sample so the water runs off in the cross direction. Proceed with the test immediately after the drain step. Place the wet sample on the lower ring of the sample holding device with the outer to surface of the product facing up, so that the wet part of the sample completely covers the open surface of the sample holding ring. If wrinkles are present, discard the sample and repeat with a new sample. After the sample is properly in place on the lower ring, turn the switch that lowers the upper ring. The sample to be tested is now securely gripped in the sample holding unit. Start the burst test immediately at this point by pressing the start button. The plunger will begin to rise. At the point when the sample tears or ruptures, report the maximum reading. The plunger will automatically reverse and return to its original starting position. Repeat this procedure on three more samples for a total of four tests, i.e., 4 replicates. Average the four replicates and divide this average by two to report wet burst per uu, to the nearest gram.

5. Total Dry Tensile Strength

The tensile strength is determined on one inch wide strips of sample using a Thwing Albert Vontage-10 Tensile Tester (Thwing-Albert Instrument Co., 10960 Dutton Rd., Philadelphia, Pa., 19154). This method is intended for use on finished paper products, reel samples, and unconverted stocks.

a. Sample Conditioning and Preparation

Prior to tensile testing, the paper samples to be tested should be conditioned according to Tappi Method #T4020M-88. The paper samples should be conditioned for at least 2 hours at a relative humidity of 48 to 52% and within a temperature range of 22° to 24° C. Sample preparation and all aspects of the tensile testing should also take place within the confines of the constant temperature and humidity room.

For finished products, discard any damaged product. Take 8 uu of tissue and stack them in four stacks of 2 uu. Use stacks 1 and 3 for machine direction tensile measurements and stacks 2 and 4 for cross direction tensile measurements. Cut two 1-inch wide strips in the machine direction from stacks 1 and 3. Cut two 1-inch wide strips in the cross direction from stacks 2 and 4. There are now four 1" wide strips for machine direction tensile testing and four 1-inch wide strips for cross direction tensile testing. For these finished product samples, all eight 1" wide strips are 2 uu thick.

For unconverted stock and/or reel samples, cut a 15-inch by 15-inch sample which is twice the number of plies in a user unit thick from a region of interest of the sample using a paper cutter (JDC-1-10 or JDC-1-12 with safety shield from Thwing-Albert Instrument Co., 10960 Dutton Road, Philadelphia, Pa. 19154). Make sure one 15-inch cut runs parallel to the machine direction while the other runs parallel to the cross direction. Make sure the sample is conditioned for at least 2 hours at a relative humidity of 48 to 52% and within a temperature range of 22° C. to 24° C. Sample preparation and all aspects of the tensile testing should also take place within the confines of the constant temperature and humidity room.

From this preconditioned 15-inch by 15-inch sample which is twice the number of plies in a user unit thick, cut four strips 1-inch by 7-inch with the long 7-inch dimension running parallel to the machine direction. Note these samples as machine direction reel or unconverted stock samples. Cut an additional four strips 1-inch by 7-inch with the long 7-inch dimension running parallel to the cross direction. Note these samples as cross direction reel or unconverted stock samples. Make sure all previous cuts are made using a paper cutter (JDC-1-10 or JDC-1-12 with safety shield from Thwing-Albert Instrument Co., 10960 Dutton Road, Philadelphia, Pa., 19154). There are now a total of eight samples: four 1-inch by 7-inch strips which are twice the number of plies in a uu thick with the 7-inch dimension running parallel to the machine direction and four 1-inch by 7-inch strips which are twice the number of plies in a uu thick with the 7-inch dimension running parallel to the cross direction.

b. Operation of Tensile Tester

For the actual measurement of the tensile strength, use a Thwing Albert Vontage-10 Tensile Tester (Thwing-Albert Instrument Co., 10960 Dutton Rd., Philadelphia, Pa., 19154). Insert the flat face clamps into the unit and calibrate the tester according to the instructions given in the operation manual of the Thwing Albert Vontage-10. Set the instrument crosshead speed to 2.00 in/min and the 1st and 2nd gauge lengths to 4.00 inches. The break sensitivity should be set to 20.0 grams and the sample width should be set to 1.00 inches and the sample thickness at 0.025 inches.

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensile strengths of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2-3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

c. Calculations

For the four machine direction 1-inch wide finished product strips, average the four individual recorded tensile readings. Divide this average by the number of user unit tested to get the MD dry tensile per user unit of the sample. Repeat this calculation for the cross direction finished product strips. To calculate total dry tensile of the sample, sum the MD dry tensile and CD dry tensile. All results are in units of grams/inch.

To calculate the Wet Burst/Total Dry Tensile ratio divide the average wet burst by the total dry tensile. The results are in units of inches.

6. Dynamic Coefficient of Friction

The dynamic coefficient of friction is measured using a Thwing-Albert Friction/Peel Tester Model 225-1. The Friction test is set up by pressing the C.O.F button on the Display Unit to select the Friction Test. The Friction Tester operated with a 2000 gram Load Cell, a padded cell of 200 grams at a speed of 6 in/min over 20 seconds. The test is initiated by depressing the Test Switch on the lower chassis of the front panel. The Load Cell will travel to the right, pulling the sled along with the affixed sample. The test results are displayed on an LCD panel. The display indicates the force in grams required for the sled to move along the test surface, i.e. the friction between usable units along with the static and dynamic coefficients of friction (COF). The displayed force returns to zero after the sled is removed from the test surface.

Ten usable units of tissue are stacked in two sets of five. Using scissors, cut one set of 5 usable units so that they are approximately 153 mm in the machine direction and approximately 114 mm in the cross-machine direction. Do not alter the second set of five usable units.

Using the test surface clamp and double sided tape, take one of the five unaltered usable units and affix to the test surface of the machine. Then, affix one usable unit of the five prepared 153 mm×114 mm prepared samples to the sled. Connect the sled to the Load Cell via the sled hook. Ensure that the LCD load (LD) reads 0.0 grams, that the sample is centered, and that the connecting wire is taut. Initiate the test by depressing the Test Switch on the lower chassis of the front panel. The results will display on the LCD panel. Remove the sled along with the usable unit from the test surface. Remove the 153 mm×114 mm usable unit from the sled. Load new usable units to the test surface and 153 mm×114 mm usable unit to the sled. Return the Load Cell to the starting position for the next test. Repeat test procedure 4 times. The five data points collected for COF are recorded and averaged for each sample condition.

7. Bending Flexibility a. Equipment:

Flexibility of the tissue product is measured using a KES-FB2 Pure Bending Tester part of the KES-FB series of Kawabata's Evaluation System. The unit is designed to measure basic mechanical properties of fabrics, non-wovens, papers and other film-like materials, and is available from Kato Tekko Co. Ltd., Kyoto, Japan.

The bending property is one of the valuable methods for determining stiffness. The KES-FB2 tester is an instrument used for pure bending tests. Unlike the cantilever method, this instrument has a special feature whereby the whole tissue product sample is accurately bent in an arc of constant radius, and the angle of curvature is changed continuously.

b. Method for Measuring Flexibility:

Tissue product samples are cut to approximately 15.2 cm×20.3 cm in the machine and cross machine directions, respectively. Each sample in turn is placed in the jaws of the KES-FB2 such that the sample would first be bent with the first surface undergoing tension and the second surface undergoing compression. In the orientation of the KES-FB2 the first surface is right facing and the second surface is left facing. The distance between the front moving jaw and the rear stationary jaw is 1 cm. The sample is secured in the instrument in the following manner.

First the front moving chuck and the rear stationary chuck are opened to accept the sample. The sample is inserted midway between the top and bottom of the jaws. The rear stationary chuck is then closed by uniformly tightening the upper and lower thumb screws until the sample is snug, but not overly tight. The jaws on the front stationary chuck are then closed in a similar fashion. The sample is adjusted for squareness in the chuck, then the front jaws are tightened to insure the sample is held securely. The distance (d) between the front chuck and the rear chuck is 1 cm.

The output of the instrument is load cell voltage (Vy) and curvature voltage (Vx). The load cell voltage is converted to a bending moment (M) normalized for sample width in the following manner:

$$\text{Moment}(M,\text{gf*cm}^2/\text{cm})=(Vy*S*d)/W$$

Where:

Vy is the load cell voltage,

Sy is the instrument sensitivity in gf*cm/V, d is the distance between the chucks, and W is the sample width in centimeters.

The sensitivity switch of the instrument is set at 5×1. Using this setting the instrument is calibrated using two 50 g weights. Each weight is suspended from a thread. The thread is wrapped around the bar on the bottom end of the rear stationary chuck and hooked to a pin extending from the front and back of the center of the shaft. One weight thread is wrapped around the front and hooked to the back pin. The other weight thread is wrapped around the back of the shaft and hooked to the front pin. Two pulleys are secured to the instrument on the right and left side. The top of the pulleys are horizontal to the center pin. Both weights are then hung over the pulleys (one on the left and one on the right) at the same time. The full scale voltage is set at 10 V. The radius of the center shaft is 0.5 cm. Thus the resultant full scale sensitivity (Sy) for the Moment axis is 100 gf*0.5 cm/10V (5 gf*cm/V).

The output for the Curvature axis is calibrated by starting the measurement motor and manually stopping the moving chuck when the indicator dial reached 1.0 cm-1. The output voltage (Vx) is adjusted to 0.5 volts. The resultant sensitivity (Sx) for the curvature axis is 2/(volts*cm). The curvature (K) is obtained in the following manner:

$$\text{Curvature}(K,\text{cm-1})=Sx*Vx$$

Where: Sx is the sensitivity of the curvature axis, and

Vx is the output voltage

For determination of the bending stiffness the moving chuck is cycled from a curvature of 0 $cm^{-1}$ to +1 $cm^{-1}$ to −1 $cm^{-1}$ to 0 $cm^{-1}$ at a rate of 0.5 cm-1/sec. Each sample is cycled continuously until four complete cycles are obtained. The output voltage of the instrument is recorded in a digital format using a personal computer. A typical output for a bending stiffness test is shown in FIG. 4. At the start of the test there is no tension on the sample. As the test begins the load cell begins to experience a load as the sample is bent. The initial rotation is clockwise when viewed from the top down on the instrument.

In the forward bend the first surface of the fabric is described as being in tension and the second surface is being compressed. The load continued to increase until the bending curvature reached approximately +1 $cm^{-1}$ (this is the Forward Bend (FB). At approximately +1 $cm^{-1}$ the direction of rotation is reversed. During the return the load cell reading decreases. This is the Forward Bend Return (FR). As the rotating chuck passes 0 curvature begins in the opposite direction—that is, the sheet side now compresses and the no-sheet side extends. The Backward Bend (BB) extended to approximately −1 $cm^{-1}$ at which the direction of rotation is reversed and the Backward Bend Return (BR) is obtained.

The data are analyzed in the following manner. A linear regression line is obtained between approximately 0.2 and 0.7 $cm^{-1}$ for the Forward Bend (FB) and the Forward Bend Return (FR). A linear regression line is obtained between approximately −0.2 and −0.7 $cm^{-1}$ for the Backward Bend (BB) and the Backward Bend Return (BR). The slope of the line is the Bending Stiffness (B). It has units of gf*$cm^2$/cm.

This is obtained for each of the four cycles for each of the four segments. The slope of each line is reported as the Bending Stiffness (B). It has units of gf*$cm^2$/cm. The Bending Stiffness of the Forward Bend is noted as BFB. The individual segment values for the four cycles are averaged and reported as an average BFB, BFR, BBF, BBR. Two separate samples in the MD and the CD are run. Values for the two samples are averaged together using the square root of the sum of the squares.

Results

The products produced above in Examples 1 and 2, as well as several exemplary and commercially available products were tested using the test methods described supra. The results of this testing data are presented below in Table 1.

TABLE 1

Exemplary test results and data values for samples analyzed as discussed herein.

| Product Type | Sample ID | Total Dry Tensile (g/in) | Wet Burst (g) | WB/TDT ratio (in) | COF - Dynamic | Basis Weight (gsm) | Bulk Density @ 95 g/$in^2$ (g/$cm^3$) | Bending Flexibility (gf*$cm^2$/cm) |
|---|---|---|---|---|---|---|---|---|
| Facial Tissue | Puffs Basic | 435 | 85 | 0.20 | 0.887 | 29 | 0.05 | 0.038 |
| | Tempo | 1715 | 232 | 0.14 | | 64 | 0.07 | 0.186 |
| | Puffs Ultra 07 | 727 | 137 | 0.19 | 0.922 | 37 | 0.07 | 0.048 |
| | Kleenex Regular | 470 | 42 | 0.09 | 1.017 | 29 | 0.07 | |
| | Kleenex Ultra | 577 | 66 | 0.11 | 0.880 | 43 | 0.05 | |
| | Example 1 | 660 | 136 | 0.21 | 0.842 | 40 | 0.08 | 0.042 |
| | Example 2 | 605 | 141 | 0.23 | 0.808 | 40 | 0.08 | 0.033 |
| Paper Toweling | Bounty Extra Soft | 1269 | 326 | 0.26 | | 60 | 0.04 | 0.223 |
| | Bounty | 1508 | 340 | 0.23 | | 42 | 0.03 | 0.127 |
| | 1st Quality | 2304 | 311 | 0.14 | | 40 | 0.03 | 0.230 |
| | Brawny | 1922 | 262 | 0.14 | | 48 | 0.04 | 0.312 |
| | Sparkle | 1930 | 213 | 0.11 | | 47 | 0.04 | 0.213 |
| | Viva Wet Laid | 727 | 336 | 0.46 | | 66 | 0.05 | 0.117 |
| | Scott 1 ply | 1623 | 282 | 0.17 | | 36 | 0.05 | 0.277 |
| Bath Tissue | Charmin Basic | 495 | 22 | 0.04 | | 30 | 0.11 | |
| | Charmin Ultra Soft | 486 | 47 | 0.10 | | 48 | 0.05 | |
| | Charmin Ultra Strong | 799 | 33 | 0.04 | | 38 | 0.04 | |
| | Scott Extra Soft | 634 | 4 | 0.01 | | 18 | 0.12 | |
| | Quilted Northern | 480 | 20 | 0.04 | | 37 | 0.06 | |
| | Quilted Northern Ultra | 444 | 20 | 0.04 | | 47 | 0.06 | |
| | Cottonelle | 429 | 29 | 0.07 | | 30 | 0.04 | |
| | Cottonelle Aloe and E | 418 | 28 | 0.07 | | 29 | 0.03 | |
| | Cottonelle Ultra | 630 | 34 | 0.05 | | 45 | 0.04 | |

A preferred embodiment of the present invention provides a wet burst value of greater than about 90 grams, preferably ranges from about 90 grams to 400 grams, more preferably ranges from about 100 grams to about 200 grams. A preferred embodiment of the present invention provides a dynamic coefficient of friction value of less than about 0.9, preferably ranging from about 0.6 to about 0.9, more preferably ranges from about 0.6 to about 0.85, and even more preferably ranges from about 0.75 to about 0.85. A preferred embodiment of the present invention provides a bending flexibility of less than about 0.1 gf $cm^2$/cm, preferably ranges from about 0.02 gf $cm^2$/cm to about 0.06 gf $cm^2$/cm, and more preferably ranges from about 0.03 gf $cm^2$/cm to about 0.05 gf $cm^2$/cm. A preferred embodiment of the present invention provides a wet burst/total dry tensile ratio value of greater than about 0.12 inches, preferably ranges from about 0.14 inches to about 0.30 inches, and more preferably ranges from about 0.16 inches to about 0.24 inches.

The dimensions and values disclosed herein are not to be understood as being strictly limited to the exact dimension and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tissue paper product having at least two plies, wherein only one outer surface of said tissue paper product has a polyhydroxy compound having a molecular weight ranging from about 150 to about 4,000 and selected from the group consisting of glycerols, polyglycerols, polyethylene glycols (PEGs), polyoxyethylenes, polyoxypropylenes, and combinations thereof applied thereto by slot extrusion, said polyhydroxy compound providing said tissue paper product with a Wet Burst greater than about 90 g, a Dynamic Coefficient of Friction less than about 0.9, and a Bending Flexibility less than about 0.042 gf $cm^2$/cm.

2. The tissue paper product of claim 1, wherein said polyhydroxy compound comprises from about 2.0 percent to about 30.0 percent of a water soluble polyhydroxy compound based upon a dry fiber weight of said tissue paper product.

3. The tissue paper product of claim 2, wherein said polyhydroxy compound comprises from about 5.0 percent to about 20.0 percent of said water soluble polyhydroxy compound based upon said dry fiber weight of said tissue paper product.

4. The tissue paper product of claim 3, wherein said polyhydroxy compound comprises from about 8.0 percent to about 15.0 percent of said water soluble polyhydroxy compound based upon said dry fiber weight of said tissue paper product.

5. The tissue paper product of claim 1, wherein said polyhydroxy compound has a weight average molecular weight of from about 150 to about 4,000.

6. The tissue paper product of claim 5, wherein said polyhydroxy compound is a polyethylene glycol (PEG) having a molecular weight ranging from about 200 to about 2,000.

7. The tissue paper product of claim 6, wherein said polyhydroxy compound is a polyglycerol having a weight average molecular weight of from about 150 to about 800.

8. The tissue paper product of claim 1, wherein said tissue paper product has a basis weight ranging from between about 5 g/$m^2$ and about 120 g/$m^2$.

9. The tissue paper product of claim 8, wherein said tissue paper product has a basis weight ranging from between about 10 g/$m^2$ and about 50 g/$m^2$.

10. The tissue paper product of claim 1, wherein said tissue paper product has a density ranging from between about 0.01 g/$cm^3$ and about 0.19 g/$cm^3$.

11. The tissue paper product of claim 1, wherein said tissue paper product is creped.

12. The tissue paper product of claim 1 further comprising a quaternary ammonium compound.

13. The tissue paper product of claim 12, wherein said quaternary ammonium compound has the formula:

$$(R_1)_{4-m}—N^+—[(CH_2)_n—Y—R_2]_mX^-$$

wherein:

m is 1 to 3;

each $R_1$ is a $C_1$-$C_6$ alkyl or alkenyl group, hydroxyalkyl group, hydrocarbyl or substituted hydrocarbyl group, alkoxylated group, benzyl group, or mixtures thereof;

each $R_2$ is a $C_{14}$-$C_{22}$ alkyl or alkenyl group, hydroxyalkyl group, hydrocarbyl or substituted hydrocarbyl group, alkoxylated group, benzyl group, or mixtures thereof; and, $X^-$ is any softener-compatible anion.

14. The tissue paper product of claim 12, wherein the quaternary ammonium compound has the formula:

$$(R_1)_{4-m}—N^+—[(CH_2)_n—Y—R_3]_mX^-$$

wherein:

Y is —O—(O)C—, or —C(O)—O—, or —NH—C(O)—, or —C(O)—NH—;

m is 1 to 3;

n is 0 to 4;

each $R_1$ is a $C_1$-$C_6$ alkyl or alkynyl group, hydroxyalkyl group, hydrocarbyl or substituted hydrocarbyl group, alkoxylated group, benzyl group, or mixtures thereof;

each $R_3$ is a $C_{13}$-$C_{21}$ alkyl or alkynyl group, hydroxyalkyl group, hydrocarbyl or substituted hydrocarbyl group, alkoxylated group, benzyl group, or mixtures thereof; and $X^-$ is any softener-compatible anion.

15. The tissue paper product of claim 1 further comprising a polysiloxane.

16. The tissue paper product of claim 15, wherein said polysiloxane has the structure:

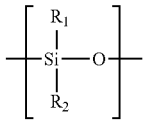

wherein, $R_1$ and $R_1$ is independently selected from the group consisting of an alkyl, aryl, alkenyl, alkaryl, aralkyl, cycloalkyl, halogenated hydrocarbon, other radical, or combinations thereof.

17. A tissue paper product having at least at least two plies, wherein only one outer surface of said tissue paper product has a polyhydroxy compound having a molecular weight ranging from about 150 to about 4,000 and selected from the group consisting of glycerols, polyglycerols, polyethylene glycols (PEGs), polyoxyethylenes, polyoxypropylenes, and combinations thereof applied thereto by slot extrusion, said polyhydroxy compound providing said tissue paper product with a Wet Burst/Total Dry Tensile ratio of greater than about 0.12 inches, a Dynamic Coefficient of Friction of less than about 0.85, and a Bending Flexibility of less than about 0.042 gf $cm^2$/cm.

18. The tissue paper product of claim 17, wherein said polyhydroxy compound comprises from about 2.0 percent to about 30.0 percent of a water soluble polyhydroxy compound based upon a dry fiber weight of said tissue paper product.

19. The tissue paper product of claim 18, wherein said polyhydroxy compound has a weight average molecular weight of from about 150 to about 4,000.

20. The tissue paper product of claim 19, wherein said polyhydroxy compound is a polyethylene glycol (PEG) having a molecular weight ranging from about 200 to about 2,000800.

21. The tissue paper product of claim 17 further comprising a polysiloxane.

* * * * *